US006252825B1

(12) United States Patent
Perotto

(10) Patent No.: US 6,252,825 B1
(45) Date of Patent: Jun. 26, 2001

(54) TIMEPIECE COMPRISING A CAPACITIVE SENSING DEVICE

(75) Inventor: Jean-Felix Perotto, Colombier (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/367,535

(22) PCT Filed: Feb. 16, 1998

(86) PCT No.: PCT/CH98/00057

§ 371 Date: Nov. 1, 1999

§ 102(e) Date: Nov. 1, 1999

(87) PCT Pub. No.: WO98/36332

PCT Pub. Date: Aug. 20, 1998

(30) Foreign Application Priority Data

Feb. 17, 1997 (FR) ..... 97 01813

(51) Int. Cl.[7] ..... G04C 9/00
(52) U.S. Cl. ..... 368/69; 368/185; 368/187
(58) Field of Search ..... 368/184–195, 368/69–71

(56) References Cited

U.S. PATENT DOCUMENTS

| | | | | |
|---|---|---|---|---|
| 4,176,458 | * | 12/1979 | Dunn | 33/141 E |
| 4,196,584 | | 4/1980 | Oda | 368/187 |
| 4,963,829 | | 10/1990 | Wereb | 324/660 |
| 5,768,088 | * | 6/1998 | Lorenz et al. | 361/287 |

FOREIGN PATENT DOCUMENTS

| | | |
|---|---|---|
| 342130 | 12/1959 | (CH) . |
| 33 17 463 A1 | 11/1984 | (DE) . |
| 3934 158 A1 | 4/1991 | (DE) . |
| 42 34 016 A1 | 4/1993 | (DE) . |
| 0 226716 | 7/1987 | (EP) . |
| 2 380 581 | 9/1978 | (FR) . |
| 2 264 784 | 9/1993 | (GB) . |

OTHER PUBLICATIONS

Patents Abstracts of Japan, vol. 007, No. 270 (P–240), Dec. 2 1983.
Patents Abstracts of Japan. JP 58 150865 A (Sony KK), Sep. 7 1983.

* cited by examiner

*Primary Examiner*—Bernard Roskoski
(74) *Attorney, Agent, or Firm*—Griffin & Szipl, P.C.

(57) ABSTRACT

A timepiece includes a rotating member (1) and a contactless electric capacitive detection device for detecting positions and/or movements of the member. In order to avoid the problems posed by conventional systems with electric switches, the detection device includes at least one capacitive sensor (2), having one or more fixed electrodes (6, 7) and a toothed rotor (5) driven by the member, and an electronic detection apparatus (3) sensitive to variations in the sensor capacitance. The device may include two capacitive sensors whose output signals are in quadrature, in order to be able to indicate the direction of rotation of the member. The rotating member may be a time-setting control stem or another component such as the shaft of a watch hand.

18 Claims, 4 Drawing Sheets

TIMEPIECE COMPRISING A CAPACITIVE SENSING DEVICE

Figure 1:
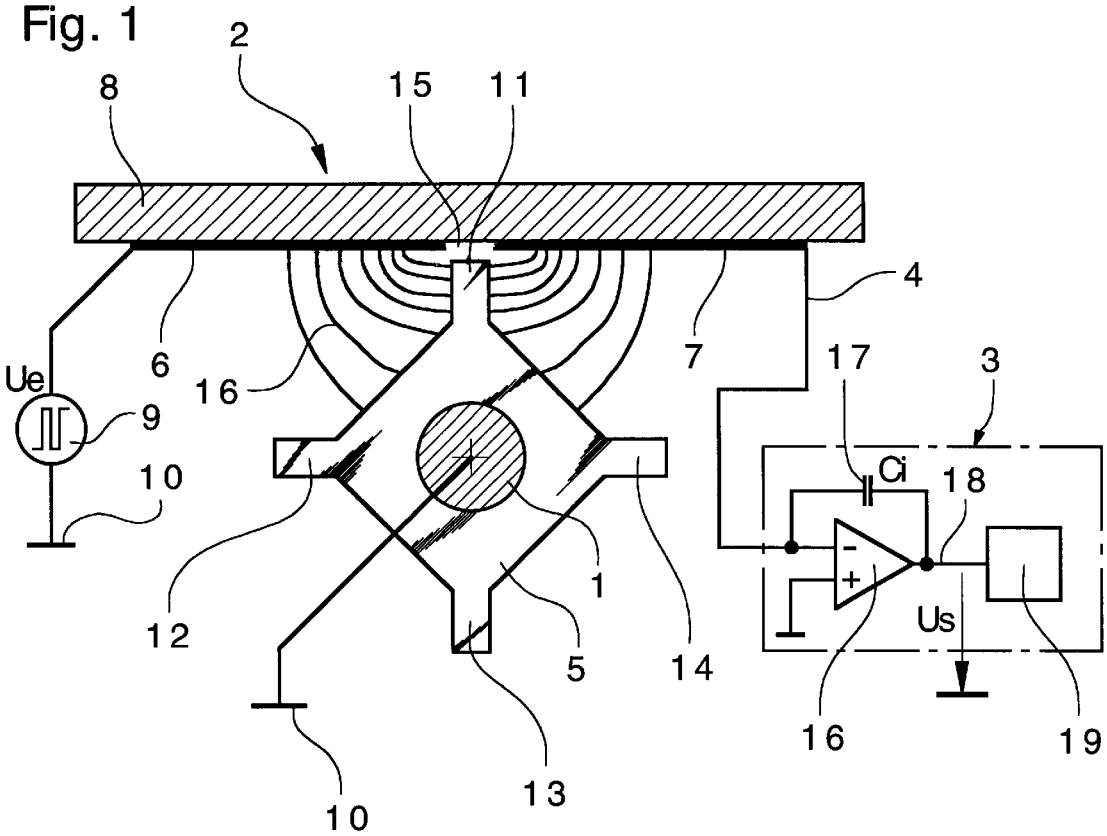

The present invention concerns a timepiece, in particular a watch, including a rotating member and an electric capacitive detection device for detecting positions and/or movements of said wheel, wherein the detection device includes at least one capacitive sensor, having a fixed portion provided with one or more fixed electrodes and a mobile portion provided with an electrically conductive rotor driven by said rotating member, and electronic detection means which are sensitive to variations in said sensor's capacitance.

The invention applies particularly, but not exclusively, to the control of functions such as the manual correction of the time or date in an electronic watch by means of the conventional control stem fitted with an external crown. Detection of said stem's movements of rotation and translation are usually essentially based on electromechanical switches actuated by an arrangement of cams attached to the stem, such cams acting on flexible contact strips which touch fixed contacts generally provided on a printed circuit which includes other timepiece components.

The main difficulty in manufacturing and assembling such switches lies in the reliability of the electric contact closure, which requires very precise positioning of each contact strip with respect to the corresponding cam and wit respect to the corresponding fixed contact. It is thus necessary to perform operating tests and perhaps adjustments during assembly of each timepiece. These operations are expensive and considerably inconvenience automation of the assembly of the watches.

Similar problems arise with electric contacts arranged to detect particular positions of a rotating member, for example the "zero" position of a chronograph hand or a date indicator.

It would thus be desirable to replace the aforementioned switches with contactless devices, able to be used in watches.

German Patent Application 3934158 A1 discloses a pulse generator able to be used for controlling an electronic watch in a domestic appliance, such generator approximately corresponding to a capacitive sensor of the type indicated in the preamble hereinbefore. A disc-shaped rotor, which rotates about an axis perpendicular to the disc, carries a flat electrode having two diametrically opposite sectors, opposite a flat stator provided with several fixed electrodes arranged in a particular manner and connected to electronic detection circuits. A thin dielectric is placed between the stator and the rotor. When the rotor rotates, pulses are generated from variations in the capacitive coupling generated by the rotor's electrode between different electrodes of the stator, as a result of variations in the overlapping surface between the rotor and each fixed electrode, while the thickness of the dielectric between the electrodes remains constant.

Such a construction requires far too much space for applications in the horological industry, in particular for watches. Moreover, the rotor must be assembled with sufficient accuracy and stability for the distance between the electrodes, i.e. the thickness of the dielectric, to remain constant.

An object of the present invention is to avoid the drawbacks of the prior art by providing a reliable contactless detection device, able to be used in a timepiece, such as a watch, able to be made and assembled inexpensively and able to be advantageously applied to correction of the time or date or detection of a particular position of a rotating member.

The invention thus concerns a timepiece as defined in the preamble, characterized in that each fixed electrode is arranged facing a peripheral surface of the rotor, said surface including teeth arranged to pass close to each fixed electrode during rotation of the rotor.

Thus, the detection device essentially acts via capacitance variation as a result of the variation in distance between the toothed peripheral surface of the rotor and each fixed electrode. By its very nature, such a device can be made in a compact, low electric energy consuming form, making it well suited to use in a watch. Moreover, capacitive sensors which allow a fairly high number of successive angular positions, for example eight or twelve positions per revolution, can be made without excessive complication.

In a particular embodiment, the fixed portion of the capacitive sensor includes a pair of fixed electrodes and the rotor is arranged to influence the electric field between the fixed electrodes by its position of rotation. The rotor may be held at a fixed potential, its teeth being arranged to form a shield in the electric field between the fixed electrodes.

These two fixed electrodes are preferably coplanar on a substrate and are separated from each other by a gap, the axis of the rotor being arranged facing said gap and parallel to the fixed electrodes. The substrate may advantageously form part of a printed circuit element of the timepiece, i.e. using an element which already exists in an electronic or electromechanical clockwork movement.

In the aforementioned embodiment, in order to maintain a constant gap between the rotor and the fixed electrodes, the rotor may be attached to the rotating member, which includes a support cylinder which abuts by sliding against a dielectric layer disposed on the substrate and/or on the fixed electrodes. This allows any adjustment of the sensor to be avoided during assembly of the rotating member.

In another arrangement with two fixed electrodes, the fixed electrodes form two respective opposite spaced plates and the rotor is disposed between them, its axis of rotation being parallel thereto. As a result of the toothed shape of the peripheral surface of the rotor, the variation in capacitance between the electrodes is due in this case to the dielectric thickness modulation. In this arrangement also, the fixed electrodes can be situated on a same printed circuit substrate, for example on two opposite edges of an opening in the substrate. The rotor may be insulated and act as transmitter of an electric signal between the two fixed electrodes. The rotor is then at a floating potential.

Another advantageous embodiment of the sensor including a pair of fixed electrodes is characterized in that the rotor is a mobile electrode which is connected to the detection means and whose teeth, during rotation thereof, pass alternately opposite one or other of the fixed electrodes. The rotor thus forms a third electrode for injecting a signal into the two capacitors which it forms respectively with the two fixed electrodes.

Another embodiment is characterized in that the fixed portion of the capacitive sensor includes an annular stator provided with inner teeth forming a fixed electrode and in that the rotor is disposed within the stator, its teeth forming a mobile electrode facing the stator teeth. One thereby obtains, in a construction of relatively small volume, electrodes having a relatively large surface and a small distance between such surfaces, thus quite a high capacitance. The higher the number of teeth, the higher the angular resolution of the sensor. The stator may be coated inside with a thin dielectric layer against which the rotor is capable of sliding, which assures the centering of the rotor within the stator.

In order for the contactless detection device to be able also to indicate the direction of rotation of the rotating member, the detection device also preferably includes two of said capacitive sensors, which are offset angularly so as to provide respective output signals which are in quadrature during rotation of the rotating member.

Figure 2:
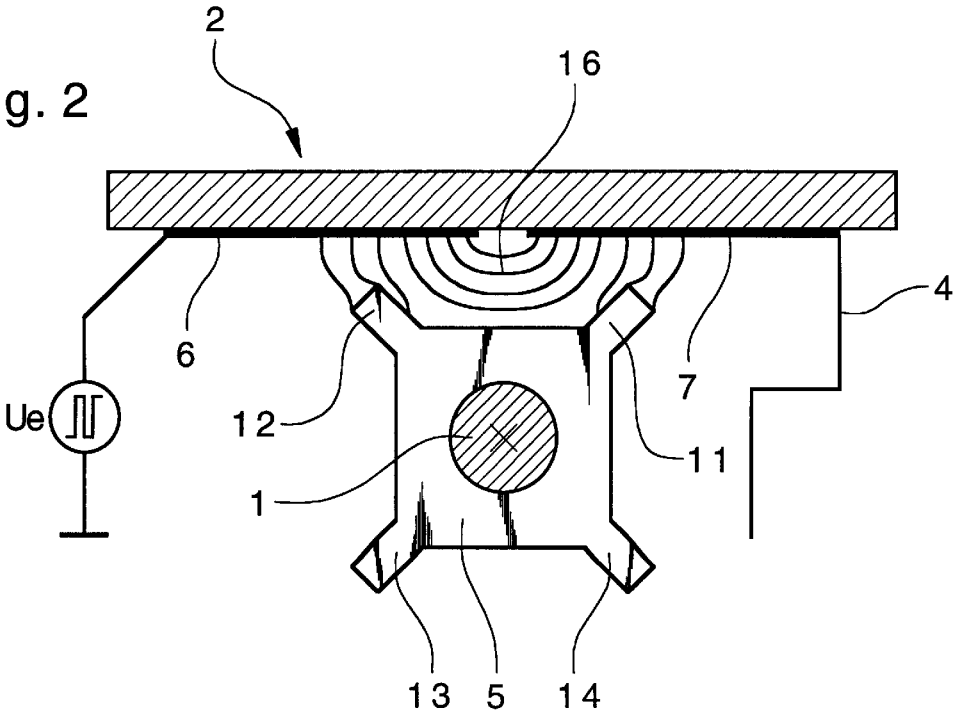
Figure 3:
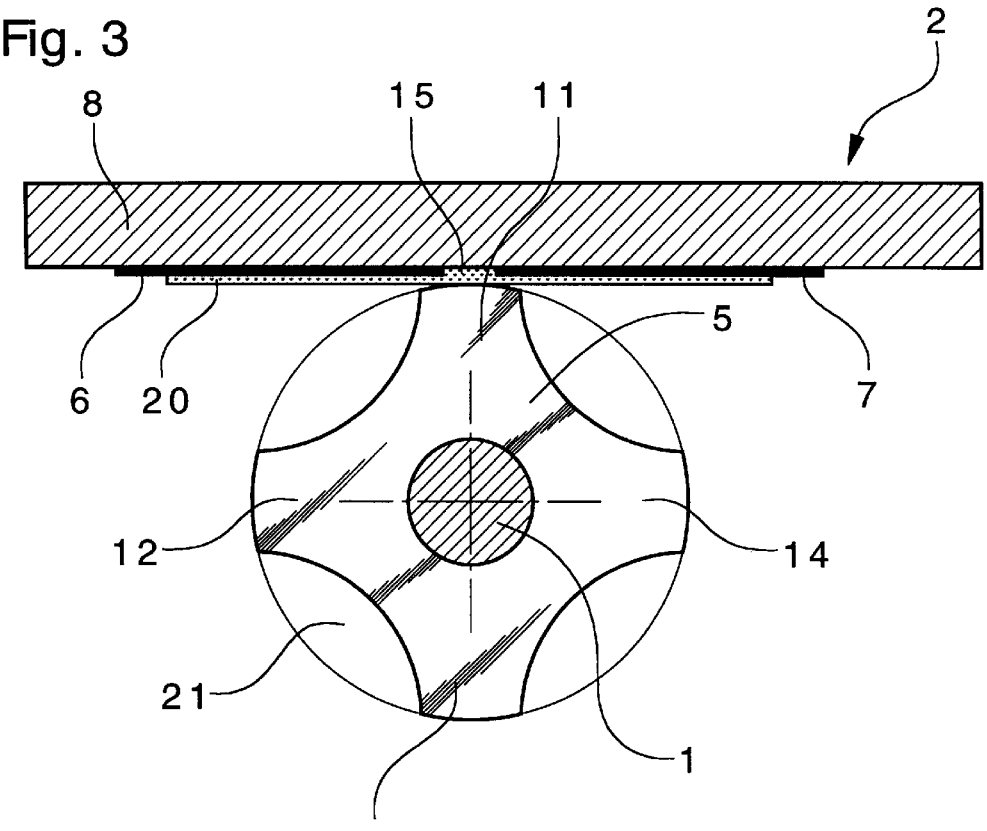
Figure 4:
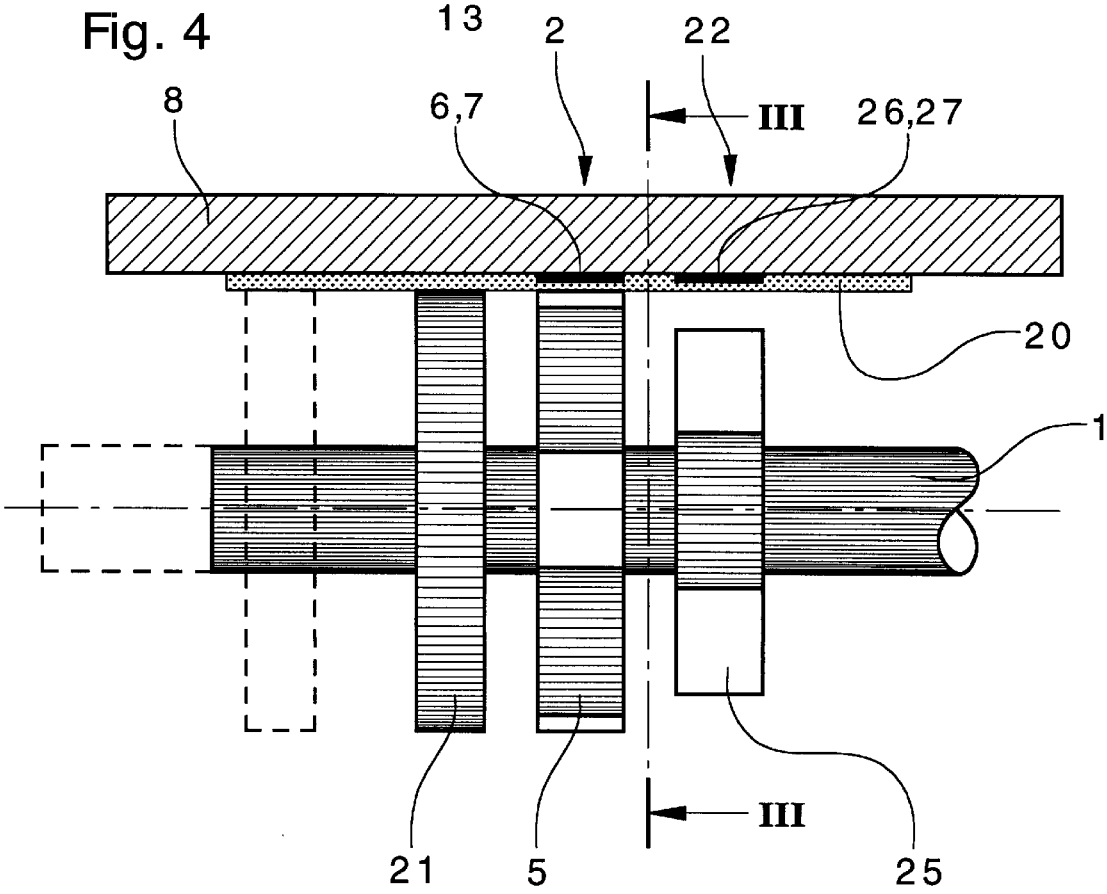
Figure 5:
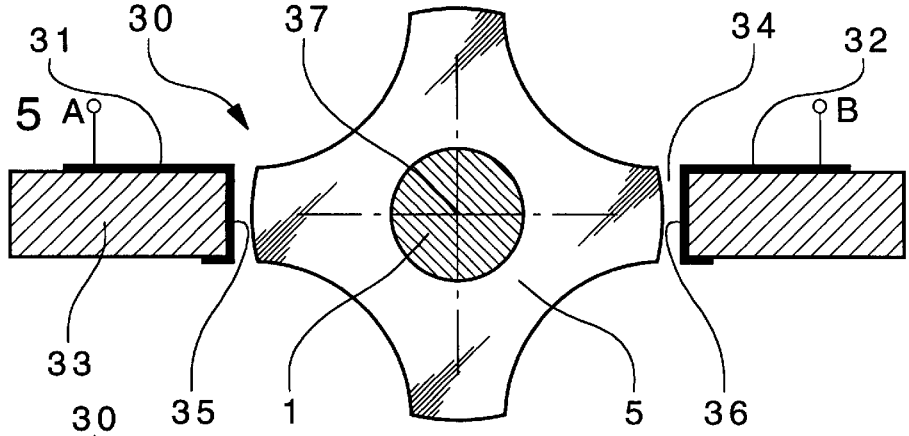
Figure 6:
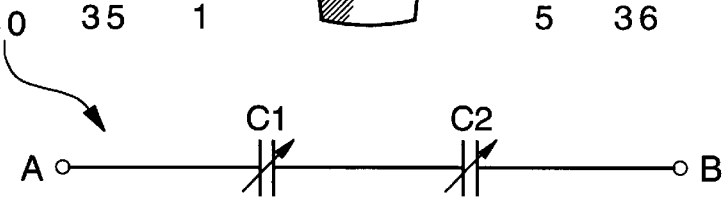
Figure 7:
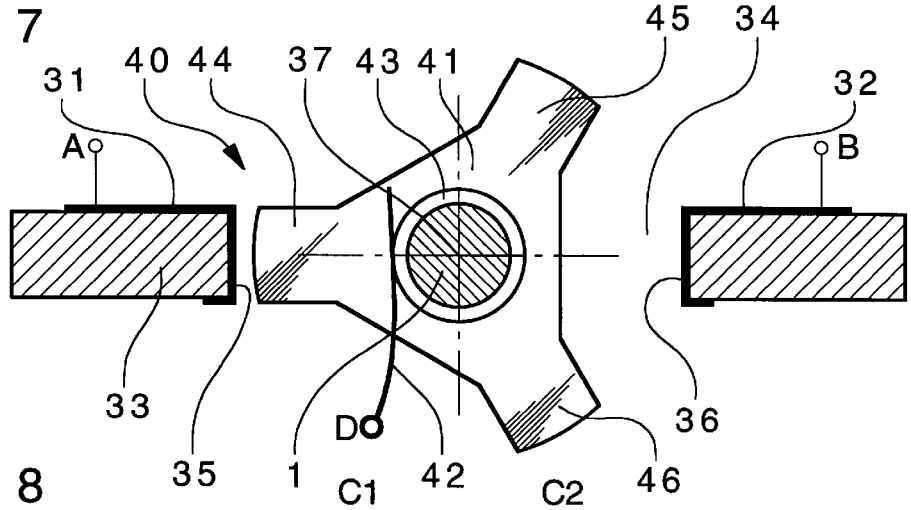
Figure 8:
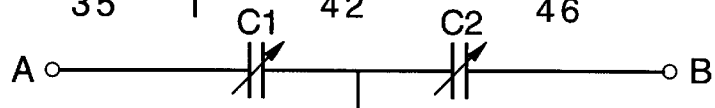
Figure 9:
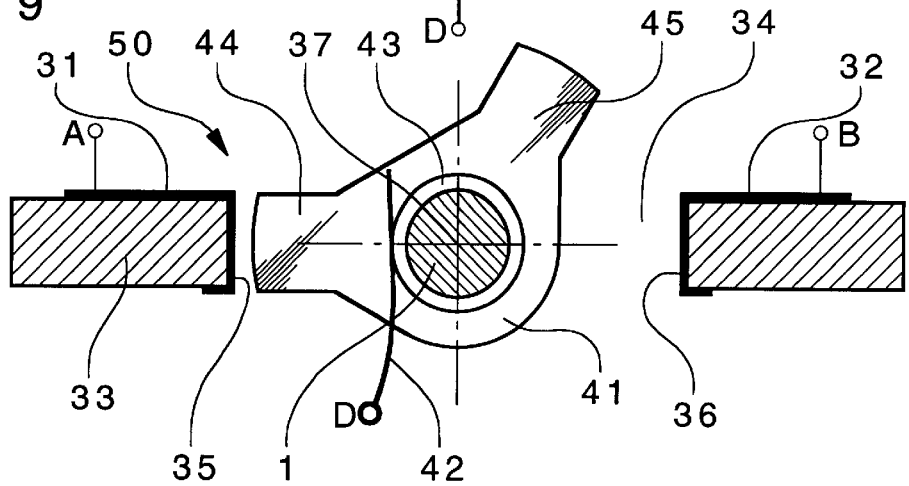
Figure 10:
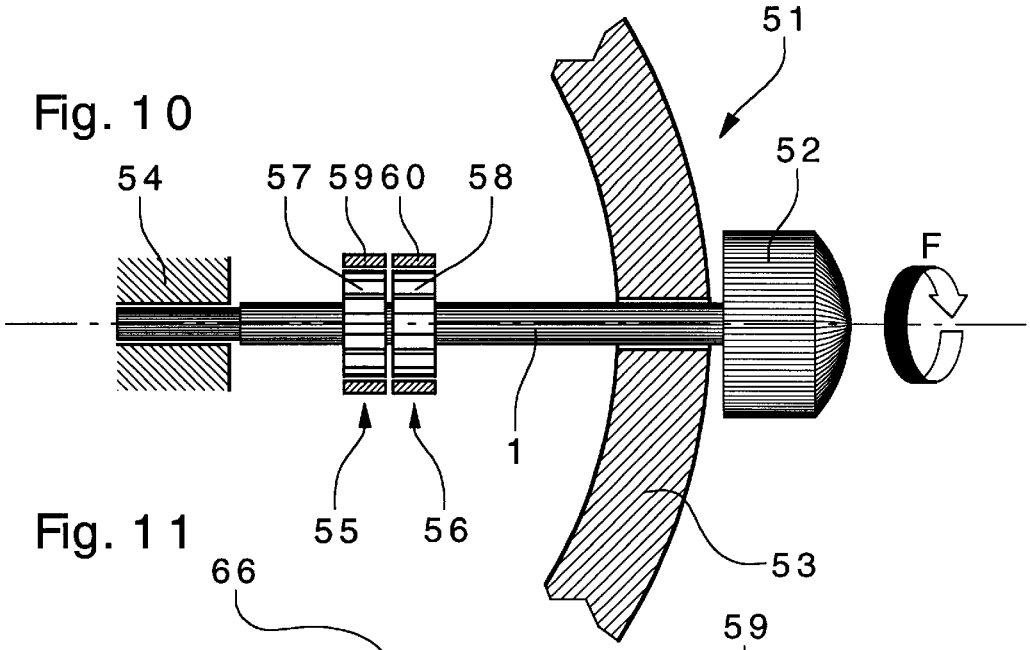
Figure 11:
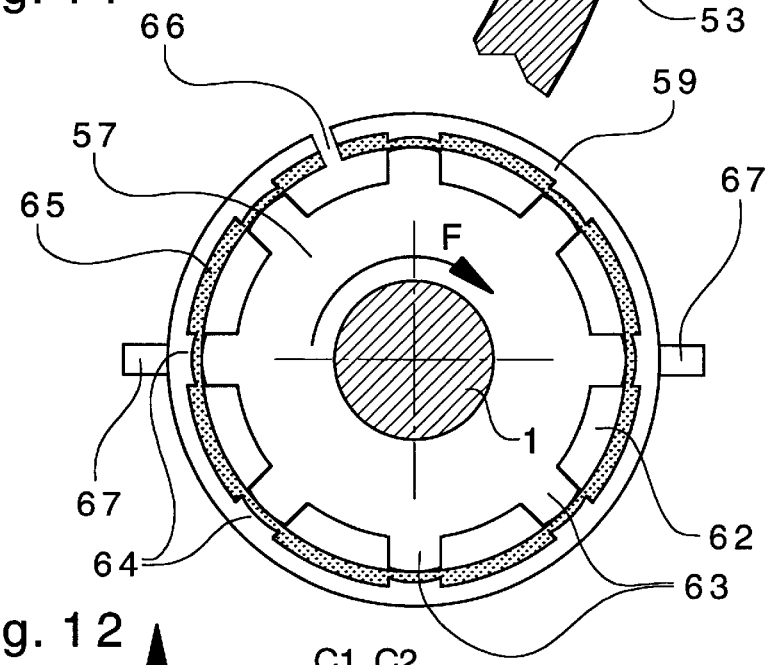
Figure 12:
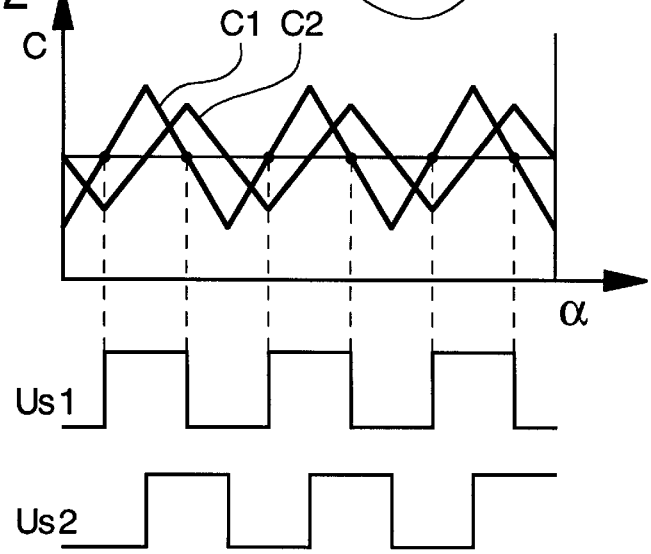

Other features and advantages of the present invention will appear in the following description of different embodiment examples, with reference to the annexed drawings, in which:

FIG. 1 shows schematically a first embodiment of the invention, more particularly a contactless device for detecting the positions of a rotating member, such device including a capacitive sensor, FIG. 2 is a similar view to FIG. 1, illustrating another position of the rotating member, FIG. 3 is a schematic transverse cross-section of a capacitive sensor used in the present invention, along the line III—III of FIG. 4, FIG. 4 is a schematic lateral view of a device including two capacitive sensors associated with a sliding and rotating member, FIG. 5 is a schematic cross-section of another embodiment of a capacitive sensor, FIG. 6 is an equivalent electric diagram of the FIG. 5 sensor, FIG. 7 is a schematic cross-section of another embodiment of a capacitive sensor, FIG. 8 is an equivalent electric diagram of the FIG. 7 sensor, FIG. 9 is a schematic cross-section of another embodiment of a capacitive sensor, FIG. 10 shows schematically another embodiment of the invention, wherein the control stem of a watch is associated with two cylindrical capacitive sensors, FIG. 11 is a transverse cross-section of one of the sensors of FIG. 10, and FIG. 12 shows electric signals obtained in the device of FIGS. 10 and 11 during rotation of the rotating member.

In the example of FIGS. 1 and 2, the member whose positions are to be detected is a stem 1 which may for example be the time-setting control stem of a watch or other timepiece. However, this member could be another clockwork movement part, for example a shaft carrying a second, minute or hour hand, or a chronograph counter hand.

Stem 1 is associated with a device for detecting its angular positions which includes a capacitive sensor 2 and electronic detection means 3 using the signal from the sensor on an output line 4. Sensor 2 includes a mobile portion, formed by a rotor 5 fixed coaxially on stem 1, and a fixed portion formed essentially by two fixed electrodes 6 and 7 which, in the present case, are coplanar and applied to the lower face of an insulating substrate 8 parallel to the axis of rotor 5. The substrate may advantageously be a printed circuit board such as exists in the majority of electronic or electromechanical watches, this board usually being parallel to the dial of the watch and to the control stem. A voltage source 9 is connected in series between the ground 10 and the first electrode 6 to apply thereto a pulsed voltage Ue. The second electrode 7 is connected to line 4 to supply an output signal which depends on the capacitance between the two electrodes 6 and 7.

Rotor 5 is a conductive part, preferably made of metal in the shape of a star, its peripheral surface in the present case having four teeth 11 to 14 which are regularly angularly spaced. Rotor 5 is preferably connected to ground 10 via stem 1. The rotor is situated opposite the gap 15 separating electrodes 6 and 7 and its teeth pass at a small distance from the electrodes. The presence and the position of the rotor thus influences the electric field 16 and thus the capacitive coupling between the electrodes. During rotation of stem 1, the capacitance of sensor 2 varies periodically and the output signal on line 4 passes by a minimum in the position of FIG. 1, where the rotor forms a shield in the electric field, and by a maximum in the position of FIG. 2, where the rotor practically does not form a shield.

In detection means 3, the sensor output signal is applied to the negative input of an amplifier 16 connected in parallel to an integration capacitor 17 of capacitance Ci. At amplifier output 18 one obtains a voltage square pulse signal Us=(Cv/Ci) Ue, where Cv is the capacitance between the two electrodes 6 and 7. Each pulse of this signal represents the passing of one of teeth 11 to 14 in front of the electrodes, thus one rotational step of stem 1, such step being a quarter of a revolution in the present example. Signal Us is used in a processing circuit 19 which controls the desired function in a known manner, for example setting the time or the date of the watch.

FIG. 3 illustrates an advantageous embodiment of capacitive sensor 2 in order to maintain a determined distance, as small as possible, between the teeth of rotor 5 and electrodes 6 and 7, so that the variations in capacitance of the sensor during movements of stem 1 are as high as possible and can thus be easily detected. A thin dielectric layer 20 is applied onto at least one portion of electrodes 6 and 7 and onto gap 15 which separates them. This layer may be formed for example of a film of resin having a thickness of a few micrometers. This thickness is evidently exaggerated in the drawing. Moreover, stem 1 carries a support cylinder 21 placed at a sufficient distance from rotor 5 not to influence the capacitance between the electrodes. Stem 1 is placed, with respect to substrate 8, in such a way that its cylinder 21 abuts slightly against layer 20, which also extends across the substrate opposite the cylinder. The end surfaces of teeth 11 to 14 of rotor 5 may be cylindrical and have the same radius as cylinder 21, so that their distance from electrodes 6 and 7 is practically equal to the thickness of dielectric layer 20.

The advantages of such an arrangement concern not only the quality of the signals obtained: since it determines positively the distance between stem 1 and substrate 8, it also allows facilitated assembly of sensor 2 by avoiding any adjustment. In particular, when stem 1 is the control stem of a watch, it is put into place after printed circuit substrate 8. The latter may be held in a resilient manner so as to abut slightly against stem cylinder 21.

FIG. 4 illustrates an embodiment including, beside capacitive sensor 2, a second similar capacitive sensor 22 in order to be able to detect the direction of rotation of stem 1. Sensor 22 includes a rotor 25 fixed onto stem 1 and a pair of electrodes 26 and 27 which are identical to electrodes 6 and 7 and applied onto substrate 8 beside the latter. These electrodes are also covered by dielectric layer 20. Rotor 25 is identical to rotor 5, but offset angularly by a quarter of the teeth pitch, i.e. a sixteenth of a revolution in the present case, so that the output signals from sensor 22 are in quadrature with those of sensor 2. Signals of this type are described hereinafter with reference to FIG. 12. As is usual, watch control stem 1 can slide axially between at least two positions, one of which is a time-setting position, shown in a continuous line in FIG. 4. The other axial position of the stem is a neutral position, shown in dotted lines, in which stem 1 must be able to rotate without correcting the time of the watch. Rotor 25 of sensor 22 is then facing electrodes 6 and 7 of sensor 2, so that sensor 2 is active, whereas sensor 22 is inactive. Processing circuits 19 detect this fact when stem 1 rotates and they do not start any action. Conversely, if the two sensors 2 and 22 supply signals in quadrature, processing circuits 19 effect a time correction the extent of which is determined by the number of steps indicated by sensor 2, and the direction by the order of succession of the signals from sensors 2 and 22.

FIGS. 5 and 6 illustrate another embodiment of a capacitive sensor able to be used instead of each of sensors 2 and 22 described hereinbefore. This sensor 30 includes two fixed electrodes disposed on a common insulating substrate 33 and connected to respective terminals A and B. Each electrode 31, 32 extends in particular across opposite edges of an opening 34 in substrate 33 to each form an electrode plate 35, 36. The axis 37 of rotating stem 1 extends in the middle of opening 34, in the median plane of the substrate, so that rotor 5 fixed to stem 1 is at substantially the same distance from each of electrodes 31 and 32. In the present case, rotor 5 includes an even number of teeth, it is electrically insulated and is at a floating potential, to act as passive transmitter of an electric signal between the two electrodes. The equivalent diagram of FIG. 6 shows that the capacitance of sensor 30 is equal to the series connection of variable capacitances C1 and C2 situated respectively between electrode 31 and rotor 5 and between rotor 5 and electrode 32. Capacitances C1 and C2 vary together via variation in the distances and thus the dielectric gaps between the conductive rotor and the electrodes when stem 1 rotates. If required, stem 1 can be guided by insulating substrate 33. Of course, it may be associated with two sensors 30 supplying signals in quadrature which allows the direction of rotation of the stem to be indicated as well, by a similar method to that described with reference to FIG. 4.

FIGS. 7 and 8 illustrate a capacitive sensor 40 in which the same elements 31 to 37 as in sensor 30 are found, but with a different rotor 41 which constitutes a mobile electrode connected to a terminal D by a flexible strip 42 which rubs against a collar 43 of rotor 41. The latter includes an odd number of teeth, for example three teeth 44, 45 and 46, which have equal angular gaps and thus pass alternately in front of one or the other of electrodes 31 and 32. Thus, capacitance C1 is maximum when capacitance C2 is minimum. Terminal D is used for injecting an electric signal onto the mobile electrode formed by rotor 41, the output signals being picked up at terminals A and B. A differential capacitance between A and B can thus be accurately measured, by removing parasitic capacitances between the different conductors and the ground, which are often much higher than C1 and C2. Another advantage of sensor 40 is that its resolution for another revolution of the rotor is equal to double the number of teeth. For example, a resolution of ten steps per revolution would be obtained with only five teeth.

FIG. 9 illustrates a capacitive sensor 50 including the same elements 31 to 37 and 41 and 43 as sensor 40 described hereinbefore, but in this case rotor 41 has only two teeth 44 and 45 disposed asymmetrically, their angular distance being for example 135°. Consequently, the signals picked up at terminals A and B succeed each other in a different order according to whether stem 1 rotates in one direction or the other. Thus the detection means can determine both the angular positions and the rotational direction of stem 1 by means of a single sensor 50.

It will be noted that it is possible to obtain the same result with a rotor having diametrically opposite teeth, if the two electrode plates 35 and 36 are not diametrically opposite with respect to axis 37 of the rotor.

In the embodiment of the invention shown in FIGS. 10 and 11, control stem 1 of a watch 51 includes a conventional external crown 52 and it is supported in a rotating and sliding manner in the watch case 52 and in a fixed portion 54 of the clockwork movement. In order to control time-setting of the watch without actuating an electric contact, stem 1 is fitted with two coaxial cylindrical capacitive sensors 55 an 56 arranged to supply output signals in quadrature, as in the example of FIG. 4. Each sensor 55, 56 includes a rotor 57, 58 made in one piece with stem 1 and an annular stator 59, 60 disposed coaxially about the rotor (when stem 1 occupies the axial position shown in FIG. 10) and fixed within the watch.

FIG. 11 is a schematic cross-section of sensor 55, in enlarged scale. The external generally cylindrical surface of metal rotor 57 is ribbed with axial grooves 62 which define between them for example eight regularly spaced external teeth 63. Likewise, metal stator 59 is ribbed inside by a same number of axial grooves which are not referenced, defining between them eight regularly spaced inner teeth 64 having the same width as teeth 63 of the rotor. In order to be adjusted and centered on the rotor, stator 59 is covered inside with a layer 65 of dielectric material, this layer being as thin as possible across teeth 64 in order to increase the capacitance of the sensor. The stator is also provided with a longitudinal slit 66 so as to be able to be resiliently applied against the periphery of the rotor. Stator 59 has for example two opposite ears 67 engaging with a small play in recesses (not shown) within the watch for fixing it to the inside of the watch. In order for the capacitance of the sensor to be as high as possible while varying sufficiently during rotation of the rotor, the circumferential width of teeth 63 and 64 is preferably slightly less than that of the grooves of the rotor and the stator. During rotation, the capacitance passes by a maximum when teeth 63 and 64 are situated facing each other and by a minimum when rotor grooves 62 are situated facing stator teeth 64.

The upper diagram of FIG. 12 shows, as a function of the angle $\alpha$ of rotation of stem 1, the variation in capacitance C1 of sensor 55 and in capacitance C2 of sensor 56. These two signals are in quadrature if, for example, teeth 63 of the two rotors 57 and 58 are mutually aligned whereas teeth 64 of stator 60 are offset by a quarter of their pitch, i.e. by $1/32$ of a revolution, with respect to those of stator 59 in the direction of rotation (arrow F) of stem 1. FIG. 12 also shows the voltage square pulses Us1 and Us2 which are obtained for each sensor as was described with reference to FIG. 1 and which allows the detection means to indicate the number of steps and the rotational direction of stem 1.

The examples described hereinbefore demonstrate that the present invention allows a contactless detection device, which advantageously replaces electric contact rotating detection devices, to be installed in a timepiece of small size, such as a watch, as a result of its simplicity and reliability.

What is claimed is:

1. A timepiece including a rotating member and an electric capacitive detection device for detecting positions and/or movements of said rotating member, wherein said detection device includes at least one capacitive sensor, having a fixed portion provided with one or more fixed electrodes and a mobile portion provided with an electrically conductive rotor driven by said rotating member, and electronic detection means which are sensitive to variations in said sensor's capacitance, wherein each fixed electrode is disposed opposite a peripheral surface of said rotor, said surface including teeth arranged to pass close to each fixed electrode during rotation of said rotor.

2. A timepiece according to claim 1, wherein said fixed portion of said sensor includes a pair of fixed electrodes, and wherein said rotor is arranged to influence the electric field between said fixed electrodes by its position of rotation.

3. A timepiece according to claim 2, wherein said rotor is held at a fixed potential, its teeth being arranged to form a shield in the electric field between said fixed electrodes.

4. A timepiece according to claim 2, wherein said teeth are distributed with a constant angular pitch about said rotor.

5. A timepiece according to claim 2, wherein said two fixed electrodes are coplanar on a substrate and are separated from each other by a gap, and wherein an axis of rotation of said rotor is disposed opposite said gap and parallel to said fixed electrodes.

6. A timepiece according to claim 5, wherein said substrate forms part of a printed circuit element of the timepiece.

7. A timepiece according to claim 5, wherein said rotor is attached to said rotating member, which includes a support cylinder which slidingly abuts against a dielectric layer disposed on said substrate and/or on said fixed electrodes.

8. A timepiece according to claim 2, wherein said fixed electrodes form two respective spaced opposite plates and wherein said rotor is disposed between said plates, its axis of rotation being parallel thereto.

9. A timepiece according to claim 8, wherein said rotor is insulated and acts as transmitter of an electric signal between said two fixed electrodes.

10. A timepiece according to claim 2, wherein said rotor is a mobile electrode connected to said detection means and whose teeth pass alternately opposite one or other of said fixed electrodes during its rotation.

11. A timepiece according to claim 1, wherein said fixed portion of said capacitive sensor includes an annular stator provided with inner teeth forming a fixed electrode, and wherein said rotor is disposed within said stator, its teeth forming a mobile electrode facing said stator teeth.

12. A timepiece according to claim 11, wherein said stator is covered internally with a dielectric layer against which said rotor is capable of abutting by sliding.

13. A timepiece according to claim 1, wherein said detection device includes two of said capacitive sensors, which are offset angularly so as to provide respective output signals which are in quadrature during rotation of said rotating member.

14. A timepiece according to claim 1, wherein said rotating member is a control stem having at least two axial positions, namely a time-setting position in which said capacitive sensor is active and at least one other position in which said sensor is inactive.

15. A timepiece according to claim 1, wherein said member is an indicator element having a reference position which is detected by said detection device.

16. A timepiece according to claim 13, wherein said rotating member is a control stem having at least two axial positions, namely a time-setting position in which one of said capacitive sensors is active and at least one other position in which said sensor is inactive.

17. A timepiece according to claim 11, wherein said detection device includes two of said capacitive sensors, which are offset angularly so as to provide respective output signals which are in quadrature during rotation of said rotating member.

18. A timepiece according to claim 17, wherein said rotating member is a control stem having at least two axial positions, namely a time-setting position in which one of said capacitive sensors is active and at least one other position in which said sensor is inactive.

* * * * *